US007289752B2

(12) United States Patent
Yamazaki et al.

(10) Patent No.: US 7,289,752 B2
(45) Date of Patent: Oct. 30, 2007

(54) TRIPOD TYPE CONSTANT-VELOCITY JOINT AND IMAGE-FORMING DEVICE

(75) Inventors: Masayuki Yamazaki, Osaka (JP); Satoru Fukuzawa, Inabe (JP); Masaaki Ohashi, Inabe (JP); Shigeo Kobayashi, Inabe (JP)

(73) Assignee: NTN Corporation, Osaka (JP)

( * ) Notice: Subject to any disclaimer, the term of this patent is extended or adjusted under 35 U.S.C. 154(b) by 191 days.

(21) Appl. No.: 11/231,813

(22) Filed: Sep. 22, 2005

(65) Prior Publication Data

US 2006/0067737 A1 Mar. 30, 2006

(30) Foreign Application Priority Data

| | | |
|---|---|---|
| Sep. 24, 2004 | (JP) | 2004-277323 |
| Dec. 6, 2004 | (JP) | 2004-353191 |
| Feb. 16, 2005 | (JP) | 2005-039529 |
| Jul. 29, 2005 | (JP) | 2005-220145 |

(51) Int. Cl.
*G03G 15/00* (2006.01)

(52) U.S. Cl. ..... 399/167; 464/111

(58) Field of Classification Search ..... 399/116, 399/167; 464/111, 120, 121, 122, 123, 139, 464/145, 146, 903
See application file for complete search history.

(56) References Cited

U.S. PATENT DOCUMENTS

| | | | | |
|---|---|---|---|---|
| 5,213,545 | A * | 5/1993 | Ide | 464/111 |
| 5,855,519 | A * | 1/1999 | Kadota | 464/145 |
| 6,435,972 | B1 * | 8/2002 | Kita et al. | 464/111 |
| 7,052,400 | B2 * | 5/2006 | Kura et al. | 464/111 |
| 2005/0061829 | A1 * | 3/2005 | Tsaur | 222/1 |
| 2005/0281586 | A1 * | 12/2005 | Ohashi et al. | 399/167 |

FOREIGN PATENT DOCUMENTS

| | | |
|---|---|---|
| JP | 3-1528 | 1/1991 |
| JP | 5-341589 | 12/1993 |
| JP | 08326770 A * | 12/1996 |

* cited by examiner

*Primary Examiner*—Robert Beatty
(74) *Attorney, Agent, or Firm*—Wenderoth, Lind & Ponack, L.L.P.

(57) ABSTRACT

A tripod type constant-velocity joint includes an outer ring formed with three axially extending track grooves circumferentially spaced apart from each other by 120 degrees. Each track groove has a pair of opposed, axially extending side faces. A tripod member is inserted in the outer ring. The tripod member includes three protrusions each slidably received in one of the track grooves and having a pair of circumferentially curved side faces each opposing one of the pair of side faces of each track groove. Torque is thus transmitted between the outer ring and the tripod member. At least the protrusions of the tripod member are formed of a synthetic resin.

18 Claims, 4 Drawing Sheets

TRIPOD TYPE CONSTANT-VELOCITY JOINT AND IMAGE-FORMING DEVICE

BACKGROUND OF THE INVENTION

The present invention relates to a tripod type constant-velocity joint through which a driving shaft and a driven shaft are coupled together so as to transmit torque from the driving shaft to the driven shaft, and an image forming device including such a tripod type constant-velocity joint.

A constant-velocity joint is typically used to transmit torque from a vehicle drive shaft to an axle.

Through such a constant-velocity joint, torque can be transmitted from a driving shaft to a driven shaft such that the driven shaft is rotated at a constant speed even if the angle between the driving shaft and the driven shaft varies. Thus, constant-velocity joints are used in various industrial machines other than motor vehicles, too.

There are known two types of constant-velocity joints, i.e. fixed type constant-velocity joints, which only allow the driving and driven shafts to incline relative to each other, and sliding type constant-velocity joints, which allow the driving and driven shafts not only to incline but to axially slide relative to each other. A sliding type constant-velocity joint is disclosed in JP patent publication 3-1528 (examined).

The constant-velocity joint disclosed in this publication, known as a tripod type constant-velocity joint, comprises an outer ring having three axial track grooves formed in the inner surface thereof so as to be circumferentially spaced apart from each other at equal angular intervals of 120 degrees, and a tripod member inserted in the outer ring so that its three radial trunnions are received in the respective track grooves. A spherical roller is rotatably and axially slidably mounted on each trunnion so as to roll along the corresponding track groove. Torque is thus transmitted between the outer ring and the tripod member through the spherical rollers.

In JP patent publication 5-341589 (unexamined), an image forming device is disclosed which includes a photoconductor drum, a motor and a universal joint through which the shaft of the photoconductor drum and the rotary shaft of the motor are coupled together. The light exposure position and the image transfer position are arranged diametrically opposed to each other on the photoconductor drum so as to cancel any circumferential shrinkage and expansion of images due to fluctuations in the rotational speed of the photoconductor drum by shrinkage and expansion of images at light exposure position and the image transfer position so that the transferred images will be substantially free of shrinkage and expansion.

The tripod type constant-velocity joint disclosed in JP patent publication 3-1528 has its outer ring, tripod member and spherical rollers all made of a metal such as steel. Thus, although such a joint is high in strength, it is heavy, needs lubrication with grease, and tends to produce loud noise. Its use is thus limited. For example, such a joint is not suitable for use in office machines, audio devices, medical instruments, food producing machines, household appliances, etc.

In order to use such a constant-velocity joint in a food processing machine, grease has to be sealed completely in order to prevent contamination of foods with grease. It is therefore necessary to provide the joint with means for preventing leakage of grease. This increases the number of parts of the joint and thus its size, and pushes up its cost, too.

In the image forming device disclosed in JP patent publication 5-341589, since the universal joint is the nonconstant-velocity type, the photoconductor drum cannot be rotated at a constant speed. Although this publication proposes to arrange the exposure position and the transfer position diametrically opposite to each other, it is actually difficult to arrange the above two positions exactly diametrically opposite to each other due to assembling errors and/or inclination of the photoconductor drum. Thus, it will be difficult to completely cancel any shrinkage and expansion of the latent image with the shrinkage and expansion of the toner image. The ultimately obtained image thus tends to be low in quality.

An object of the present invention is to provide a tripod type constant-velocity joint which can be easily assembled and disassembled, which needs no lubrication with grease, which is lightweight, compact in size and quiet in operation, and which is less limited in utility.

Another object of the present invention is to provide an image forming device which includes a means for rotating the photoconductor drum always at a constant speed, and of which the maintenance is easy.

SUMMARY OF THE INVENTION

According to the present invention, there is provided a tripod type constant-velocity joint comprising an outer ring formed with three axially extending track grooves circumferentially spaced apart from each other by 120 degrees, the track grooves each having a pair of opposed, axially extending side faces, and a tripod member inserted in the outer ring and having three protrusions each slidably received in one of the track grooves and having a pair of circumferentially curved side faces each opposing one of the pair of side faces of each track groove, whereby torque can be transmitted between the outer ring and the tripod member, the tripod member, including the protrusions, being formed of a synthetic resin.

Preferably, each of the protrusions is formed with a pair of flat surfaces forwardly and rearwardly of the each protrusion with respect to the axis of the outer ring, the distance between the pair of flat surfaces being smaller than the distance between the pair of curved side faces of each of the protrusions to reduce the axial length, weight and size of the tripod type constant-velocity joint.

The pair of curved side faces of each of the protrusions may be portions of a sphere having a center located on the axis of the corresponding protrusion, or portions of a cylinder having its axis coincident with the axis of the corresponding protrusion.

To minimize the weight of the joint, both the outer ring and the tripod member may be made of a synthetic resin or resins.

The synthetic resin or resins are preferably an injection-moldable resin or resins because the various parts of the joint can be more easily formed from injection-moldable resins.

Further preferably, the synthetic resin or resins are a lubricating resin or resins to reduce the operating noise of the tripod type constant-velocity joint.

Preferably, the outer ring and the tripod member are made of different synthetic resins from each other, for example, one of the outer ring and the tripod member is made of a lubricating resin, and the other of the outer ring and the tripod member is made of a non-lubricating engineering plastic, to prevent the outer ring and the tripod member from adhering to each other at their sliding contact portions, thereby slowing deterioration in the isokinetic properties of the joint due to wear. The joint can thus keep its high isokinetic properties for a prolonged period of time. That is, its durability improves.

By applying a preload to the contact portions between the track grooves and the protrusions, it is possible to eliminate any circumferential plays in the tripod type constant-velocity joints, thereby improving its isokinetic properties.

From another aspect of the invention, there is provided an image forming device comprising a photoconductor drum having drum shafts, a driving unit having a drive shaft for driving the photoconductor drum, a light exposure unit for forming an electrostatic latent image on the photoconductor drum, a developing unit for supplying toner to the electrostatic latent image on the photoconductor drum to form a toner image, a transfer unit for feeding a transfer material at the same speed as a peripheral speed of the photoconductor drum to transfer the toner image onto the transfer material, and the abovementioned constant-velocity joint, through which the drive shaft of the driving unit is coupled to one of the drum shafts of the photoconductor drum.

By forming at least the tripod member, including the protrusions, from a synthetic resin, it is possible to reduce the weight of the joint and also reduce the operating noise while torque is being transmitted. Since no lubrication with grease is necessary, it is not necessary to provide a boot, either. Thus, it is possible to simplify and reduce the size of the tripod type constant-velocity joint.

Such a constant-velocity joint is less limited in utility. For example, the constant-velocity joint according to the present invention can be used in office machines, audio devices, medical devices, household appliances and other devices and instruments in which it was difficult to use conventional constant-velocity joints. This increases the freedom of design of these devices and instruments and reduces their size and cost.

According to the second aspect of the invention, by coupling the drive shaft of the driving unit with one of the drum shafts of the photoconductor drum through a tripod type constant-velocity joint, the photoconductor drum can be rotated at a constant speed even if the drum shafts of the photoconductor drum and the rotary shaft of the motor are inclined relative to each other or otherwise not aligned with each other.

By rotating the photoconductor drum at a constant speed, it is possible to prevent shrinkage or expansion of any electrostatic latent image formed on the photoconductor drum, and also to prevent any toner image on the photoconductor drum from shrinking or expanding when it is transferred onto the transfer material A by the transfer/electrifier. Thus, it is possible to form high-quality images.

Since the tripod type constant-velocity joint needs no lubrication with grease, maintenance of the image forming device is easy. It is also possible to completely eliminate the possibility of the transfer material A being soiled with grease.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

Figure 1:
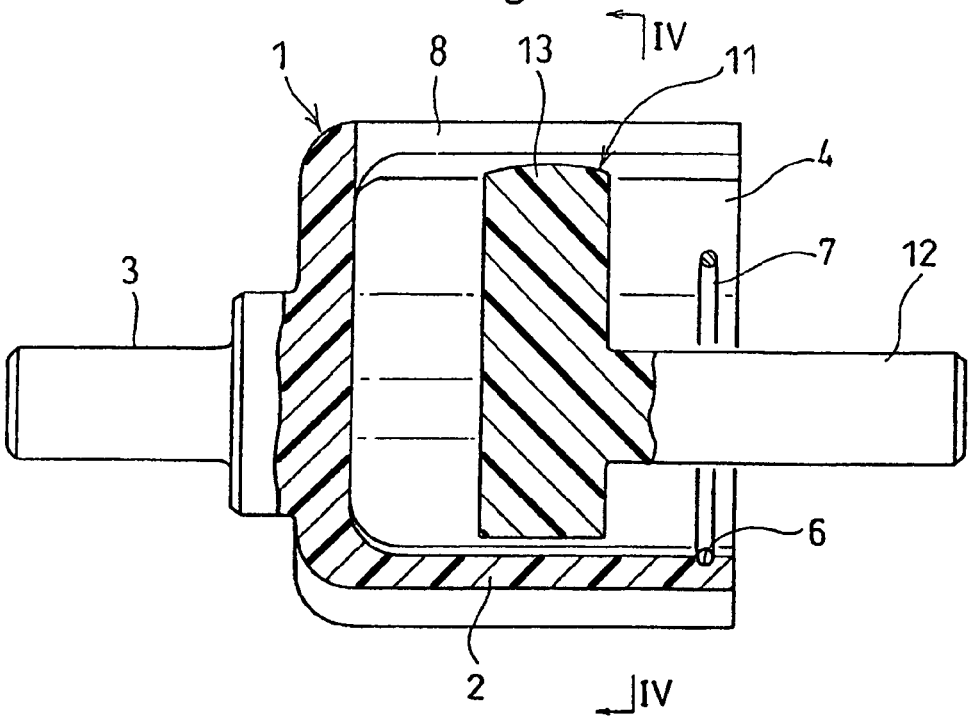
FIG. 1 is a vertical sectional front view of a tripod type constant-velocity joint embodying the present invention.

The embodiment of the present invention is now described with reference to the drawings. As shown in FIGS. 1 to 4, the tripod type constant-velocity joint according to the present invention comprises an outer ring 1 and a tripod member 11 inserted in the outer ring 1.

The outer ring 1 includes a cup 2 having an opening at one end, and an end wall closing the other end thereof. A first shaft 3 is integrally formed on the outer surface of the end wall of the cup 2. Three track grooves 4 are formed in the inner surface of the outer ring 1 so as to axially extend from the open end of the cup 2 and so as to be circumferentially spaced apart from each other at equal intervals of 120 degrees. Each track groove 4 has a pair of circumferentially opposed, flat side faces 5 that extend parallel to each other.

The tripod member 11 carries a second shaft 12 and is integrally provided with three protrusions 13 inserted in the respective track grooves 4 of the outer ring 1.

Each protrusion 13 is slidable in and along the corresponding track groove 4, and has spherical side faces 14*a* so as to oppose the respective side faces 5 of the track groove 4. The spherical side faces 14*a* have their centers located on the axis of the protrusion 13. Since the side faces 14 are spherical surfaces, they are curved both circumferentially and axially.

Forwardly and rearwardly of each protrusion 13 with respect to the axial direction of the outer ring, flat surfaces 14*b* are formed so as to be parallel to each other. The forward flat surfaces 14*b* of the protrusions 13 are flush with the front face of the body of the tripod member 11, while the rear flat surfaces 14*b* of the the protrusions 13 are flush with the rear face of the body of the tripod member 11. The distance between the flat surfaces 14*b* of each protrusion 13 is smaller than the maximum distance between the spherical surfaces 14*a* of each protrusion 13 (i.e. the diameter of the sphere on which the spherical surfaces 14*a* lie).

When torque is applied to one of the first shaft 3 and the second shaft 12, one of the spherical surfaces of 14*a* of each protrusion 13 engages the opposed side face 5 of the track groove 4, so that torque is transmitted between the outer ring 1 and the tripod member 11 through these engaged portions.

If the first shaft 3 and the second shaft 12 are inclined relative to each other while torque is being transmitted therebetween, the protrusions 13 will slide axially in the respective track grooves 4. When the protrusions 13 slide in the track grooves 4, the protrusions 13 will scarcely encounter slide resistance because the spherical surfaces 14*a* are brought into point contact with the flat side faces 5 of the track grooves 4. Thus, they can slide smoothly in the track grooves 4.

Instead of the spherical surfaces 14*a*, each protrusion 13 may have a pair of cylindrical side faces having their axis coincident with the axis of the protrusion 13. In this case, the side faces are curved only in the circumferential direction.

Figure 2:
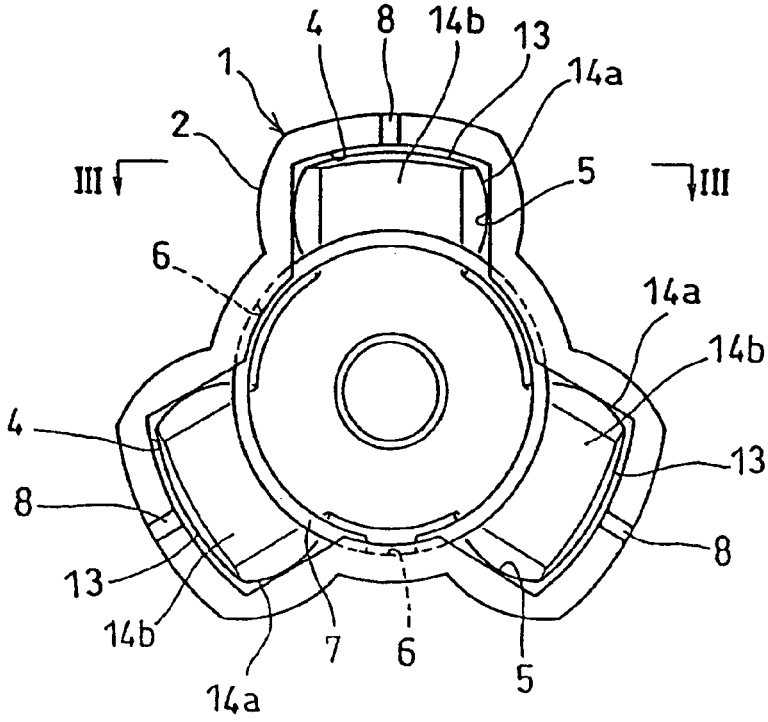
FIG. 2 is a right-hand side view of FIG. 1.
Figure 3:
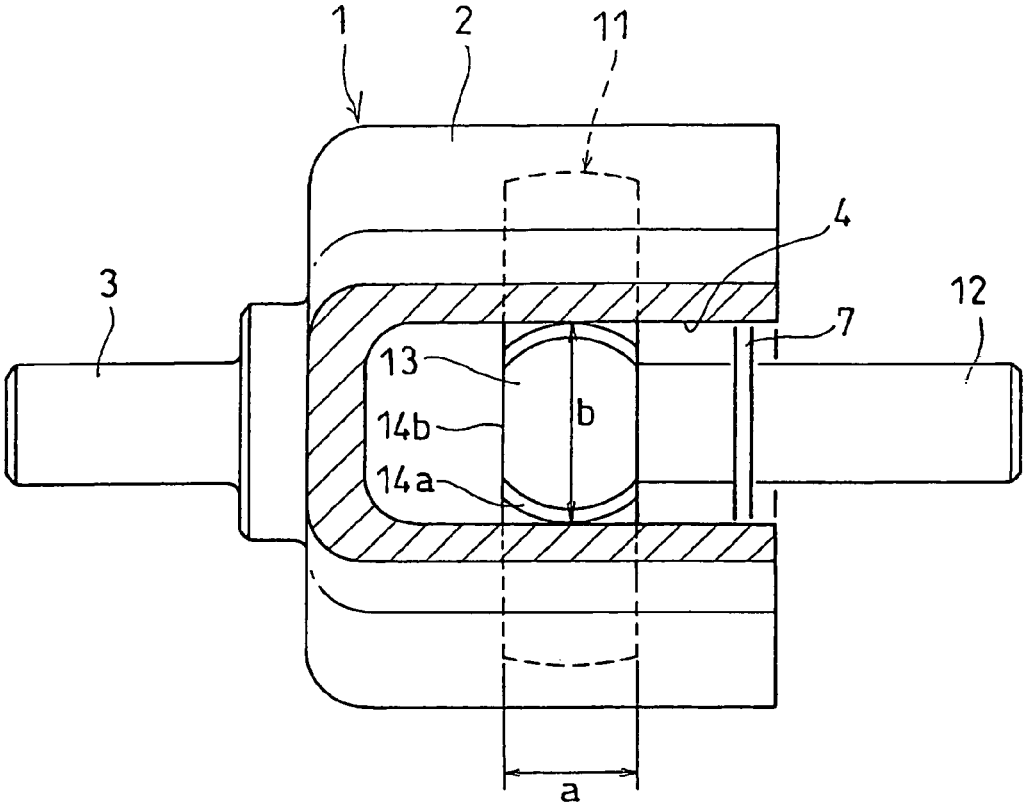
FIG. 3 is a sectional view taken along line III-III of FIG. 2.
Figure 4:
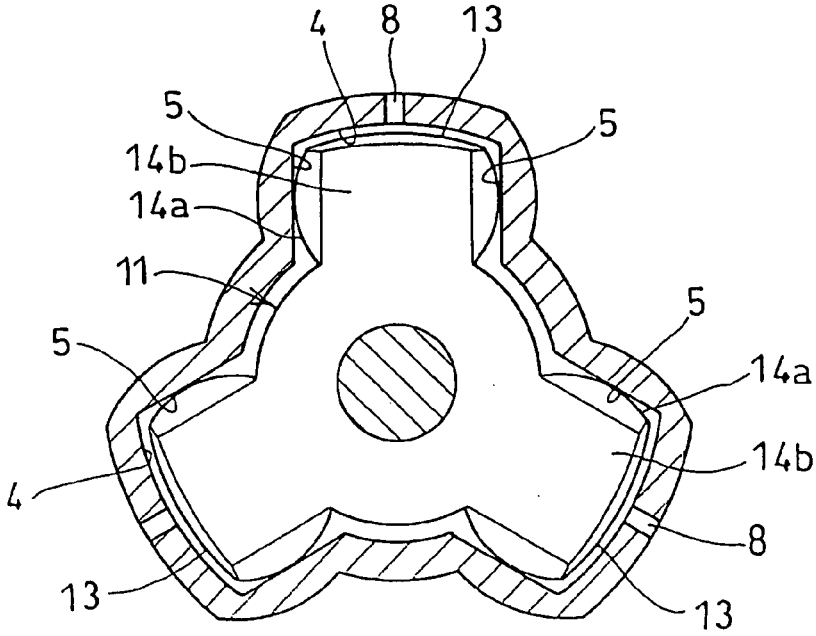
FIG. 4 is a sectional view taken along line IV-IV of FIG. 1.

As shown in FIGS. 1 and 2, the cup 2 of the outer ring 1 is formed with circumferentially aligned grooves 6 in its inner surface near the open end. A snap ring 7 having circumferentially separated ends is received in the grooves 6 to prevent the tripod member 11 from slipping out of the cup 2 through its open end.

The outer ring 1 and the entire tripod member 11, including the protrusions 13, are formed of a synthetic resin. A suitable synthetic resin should be selected taking into consideration the use conditions of the tripod type constant-velocity joint. Preferably, an injection-moldable synthetic resin is selected. If an injection-moldable resin is selected, it may be either a thermoplastic resin or a thermosetting one.

Some injection-moldable resins are crystalline and others are amorphous. While either type is usable in the present invention, a crystalline resin is preferable because an outer ring and/or a tripod member made of an amorphous resin tends to break suddenly if torque above the upper limit is applied due to low toughness of an amorphous resin.

Preferable synthetic resins include synthetic resins that are high in lubricity, such as polyacetal resins (POM), nylon resins, injection-moldable fluororesins including perfluoroalkoxyethylene (PFA), fluoroethylenepropylene (FEP) and polyethylene-tetrafluoroethylene (ETFE), and injection-moldable polyimide resins, polyphenylene sulfide resins (PPS), full aromatic polyester resins, polyether ether ketone resins (PEEK) and polyamide-imide resins.

The outer ring and the tripod member may be made of only one of these resins, a polymer alloy which is a mixture of two or more of these resins, or a polymer alloy which is a mixture of a synthetic resin other than the abovementioned resins which is lower in lubricity, and at least one of the abovementioned synthetic resins.

Further, the outer ring and the tripod member may be made only of a synthetic resin that is low in lubricity in itself if its lubricity is improved by adding a solid lubricant or a lubricating oil thereto. The solid lubricant added may be polytetrafluoroethylene, graphite or molybdenum disulfide.

In order to increase the strength of the outer ring and the tripod member, glass fibers, carbon fibers or mineral fibers (whiskers) may be added to the synthetic resin or resins. Solid lubricants may be used together with such fibers.

Most preferably, the outer ring and the tripod member are formed of POM, a nylon resin, PPS or PEEK. The nylon resin used may be nylon 6, nylon 66, nylon 610, nylon 612, nylon 11, nylon 12, nylon 46 or a semi-aromatic nylon having an aromatic ring in its molecular chain. Because POM, nylon resins and PPS are sufficiently heat-resistant and high in lubricity, and still, they are relatively inexpensive, by using one or more than one of these materials, a high cost-performance constant-velocity joint is provided.

As is apparent from the above description, since the outer ring 1 and the tripod member 11 are made of a synthetic resin, the constant-velocity joint is lightweight, and produces little noise while torque is being transmitted therethrough. No grease is necessary for lubrication. Since no lubrication with grease is necessary, it is not necessary to provide a boot, either. Thus, it is possible to reduce the number of parts, thereby simplifying and reducing the size of the tripod type constant-velocity joint. PEEK provides superior mechanical strength and lubricity without adding a reinforcing material or a lubricant. Thus, by using PEEK, a high-performance tripod type constant-velocity joint is provided.

The constant-velocity joint of the present invention can therefore be used in a wide variety of devices and machines, including food processing machines.

If the tripod type constant-velocity joint is used in a medical instrument or a food preparation machine, a white or whitish resin should be used to give users hygienic impressions. Among such synthetic resins, POM is the most preferable because it is whitish in color and high in lubricity, thereby eliminating the need for grease.

Preferably, the outer ring 1 and the tripod member 11 are made of different synthetic base resins from each other, for example, the outer ring 1 is made of e.g. an injection-moldable polyimide resin or PPS, and the tripod member 11 is made of a full aromatic polyester resin, PEEK or polyamide-imide resin, to prevent the outer ring 1 and the tripod member 11 from adhering to each other at their sliding contact portions, thereby slowing deterioration in the isokinetic properties of the joint due to wear. The joint can thus keep its high isokinetic properties for a prolonged period of time. That is, its durability improves.

In the embodiment, the second shaft 12 and the entire tripod member 11, including the protrusions 13, are formed of a synthetic resin. In an alternative arrangement, the protrusions 13 and the body of the tripod member 11 are integrally formed of a synthetic resin, the second shaft 12 is formed of a ceramic material or a metal such as steel, stainless steel or an aluminum alloy, and the second shaft 12 is joined to the tripod member 11 by such means as bonding, serrations or a bolt. If, as in the embodiment, the entire tripod member 11, including the protrusions 13, is formed of a synthetic resin, such a tripod member can be molded in a mold having no undercuts because the side faces of the protrusions 13 are the spherical surfaces 14*a* or cylindrical surfaces.

If the second shaft 12 is relatively long, the second shaft 12 is preferably formed of a ceramic material or a metal to minimize the torque loss.

In the embodiment, the cup 2 and the first shaft 3 of the outer ring 1 are integrally formed of a synthetic resin. But instead, the first shaft 3 may be formed of a ceramic material or a metal such as steel, stainless steel or an aluminum alloy, and coupled to the cup 2.

In this embodiment, since the outer ring 1 is formed of a synthetic resin, it is possible to apply a preload to the contact portions between the protrusions 13 and the side faces 5 of the track grooves 4, utilizing the resilience of the outer ring. Specifically, by determining the distance between the side faces 5 of each track groove 4 at a value smaller than the diameter of the sphere defined by the spherical surfaces 14*a* of each protrusion 13, it is possible to apply a preload to the contact portions between the protrusions 13 and the side faces 5 of the track grooves 4. Since the protrusions 13 are formed of a synthetic resin, no wedging or seizure will occur even without lubrication. The joint thus operates smoothly.

Even if the outer ring 1 is not made of a synthetic resin but made of a ceramic material or a metal such as steel, stainless steel or an aluminum alloy, if the protrusions 13 are formed of a synthetic resin, it is possible to apply a preload to the contact portions between the protrusions 4 and the side faces of the track grooves 4, utilizing the resilience of the protrusions 13. Specifically, by determining the dimension between the spherical surfaces 14*a* of each protrusion 13 at a value greater than the distance between the side faces 5 of each track groove 4, it is possible to apply a preload to the contact portions between the protrusions 13 and the side faces 5 of the track grooves 4.

By applying a preload to the protrusions 13 in the manner as described above, it is possible to eliminate any circumferential plays in the tripod constant-velocity joints, thereby improving its isokinetic properties.

As shown in FIGS. 1 and 2, a slit 8 may be formed in the cup 2 at its portion forming the outer wall of each track groove 4 so as to extend axially from its open end. The axial slits 8 allow the cup 2 to be resiliently deformed in the axial direction, thereby making it easier to apply a preload to the protrusions 13. The slits 8 also make it unnecessary to strictly control the width dimension of the track grooves 4. The outer ring 1 can thus be manufactured easily.

Figure 5:
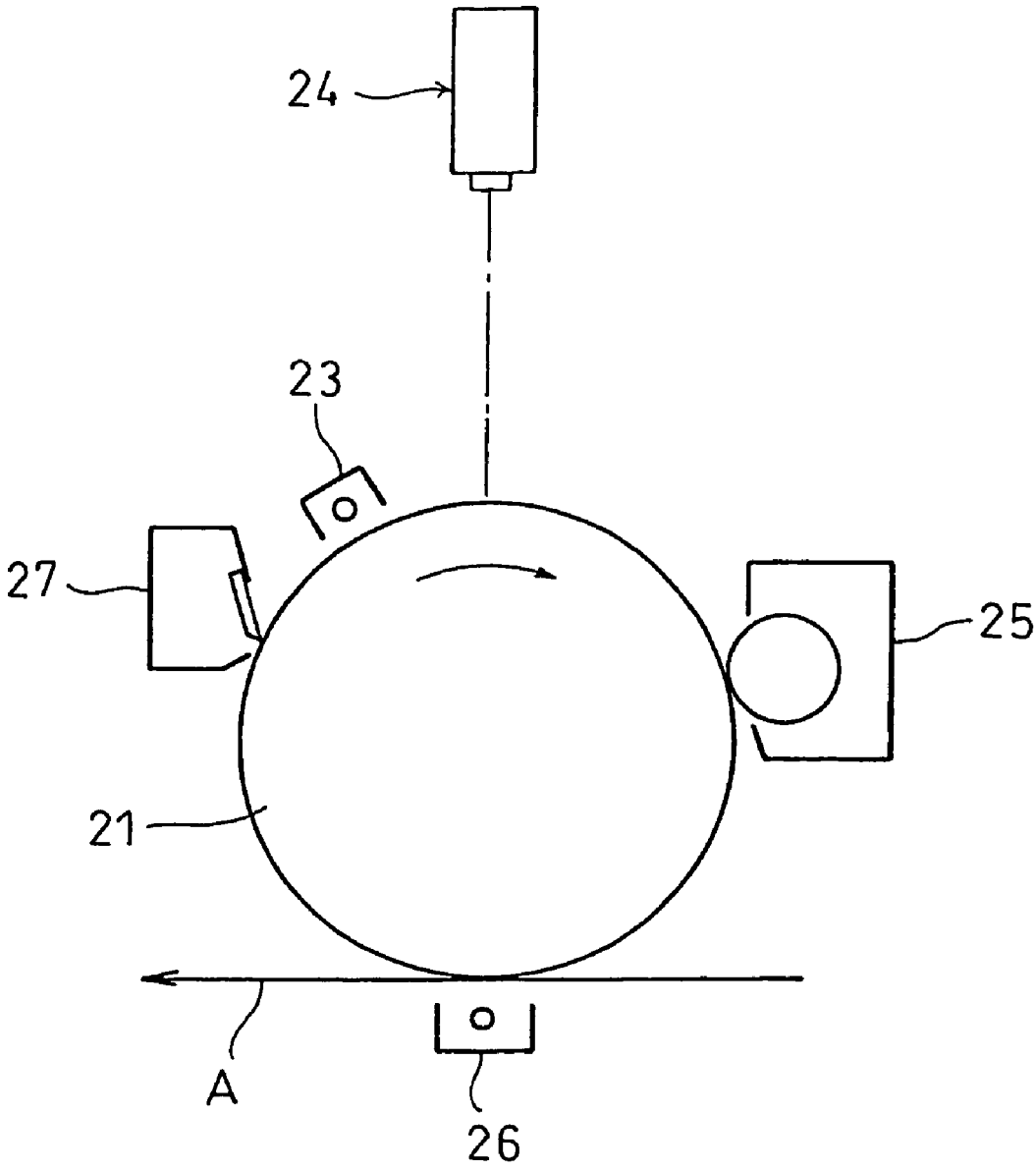
FIG. 5 is a schematic view of an image forming device embodying the present invention.
Figure 6:
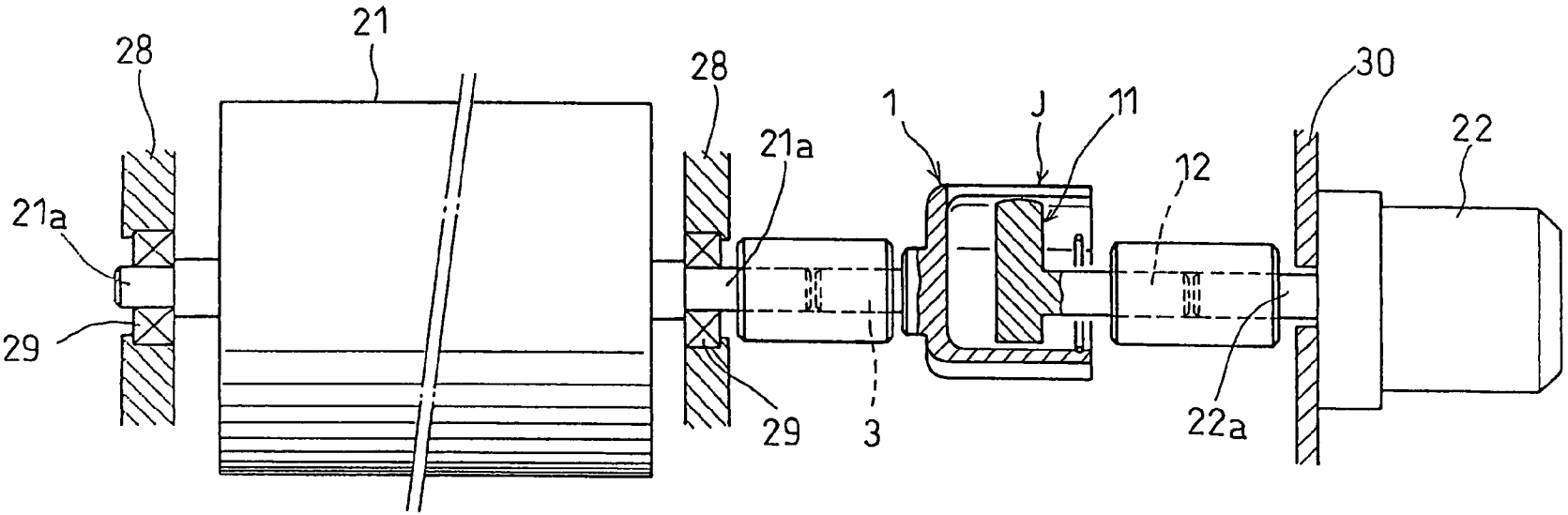
FIG. 6 is a partially cutaway front view of the driving unit for driving the photoconductor drum of the image forming device of FIG. 5.

FIGS. 5 and 6 show an image forming device according to the present invention. FIG. 5 shows a monochrome image forming device having a photoconductor drum 21 which is driven by a motor 22 shown in FIG. 5 in the direction of the arrow of FIG. 5. Around the photoconductor drum 21, an electrifier 23, a light exposure unit 24, a developing unit 25, a transfer/electrifier 26 and a cleaner 27 are arranged in this order in the direction of rotation of the photoconductor drum 21.

While the photoconductor drum 21 is rotating, the electrifier 23 uniformly electrostatically charges the outer periphery of the photoconductor drum 21, the light exposure apparatus 24 then emits image-forming light based on image information onto the drum 21 to form an electrostatic latent image on the drum 21, the developing unit 25 supplies toner onto the latent image to form a toner image, and the toner image is transferred onto a transfer material A that is being fed by the transfer/electrifier 26 at the same speed as the peripheral speed of the photoconductor drum 21 to form an image on the transfer material A. After transferring the image, any toner remaining on the drum 21 is removed by the cleaner 27.

As shown in FIG. 6, the photoconductor drum 21 carries drum shafts 21*a* at both ends, each rotatably supported on one of a pair of side frames 28 through a bearing 29. The motor 22 for driving the photoconductor drum 21 is mounted on a casing 30 so as to axially oppose the photoconductor drum 21.

The rotary shaft 22*a* of the motor 22 is connected to one of the drum shafts 21*a* of the photoconductor drum 21 through a tripod type constant-velocity joint J.

As the constant-velocity joint J, the tripod type joint shown in FIGS. 1 to 4 is used.

The tripod type constant-velocity joint J allows the photoconductor drum 21 to rotate at a constant speed even if the drum shafts 21*a* of the photoconductor drum 21 and the rotary shaft 22*a* of the motor 22 are inclined relative to each other or otherwise not aligned with each other. By rotating the photoconductor drum 21 at a constant speed, it is possible to prevent shrinkage or expansion of any electrostatic latent image formed on the photoconductor drum 21, and also to prevent any toner image on the photoconductor drum 21 from shrinking or expanding when it is transferred onto the transfer material A by the transfer/electrifier 26.

Thus, it is possible to form high-quality images. Also, because the exposure unit 24 and the transfer/electrifier 26 need not be arranged so as to be diametrically opposite to each other, the image forming device can be designed more freely.

Since the tripod type constant-velocity joint needs no lubricating grease, and can be easily assembled and disassembled simply by inserting the tripod member into the outer ring and pulling the tripod member out of the outer ring with the snap ring 7 removed, maintenance of the image forming device is easy. Also, it is possible to completely eliminate the possibility of the transfer material A being soiled with splashed grease.

The image forming device shown in FIG. 5 is a monochrome image forming device. A full-color image forming apparatus comprises four monochrome image forming devices of FIG. 5 that are arranged in tandem in the feed direction of the transfer material A. In the respective image forming devices, yellow, magenta, cyan and black toners are used to form toner images of four different colors, and the toner images are superposed on the transfer material A to form a color image.

What is claimed is:

1. A tripod type constant-velocity joint comprising an outer ring formed with three axially extending track grooves circumferentially spaced apart from each other by 120 degrees, said track grooves each having a pair of opposed, axially extending side faces, and a tripod member inserted in said outer ring and having three protrusions each slidably received in one of said track grooves and having a pair of circumferentially curved side faces each opposing one of said pair of side faces of each track groove, whereby torque can be transmitted between said outer ring and said tripod member, said tripod member, including said protrusions, being formed of a synthetic resin.

2. The tripod type constant-velocity joint of claim 1 wherein each of said protrusions is formed with a pair of flat surfaces forwardly and rearwardly of said each protrusion with respect to an axis of said outer ring, the distance between said pair of flat surfaces being smaller than the distance between said pair of curved side faces of each of said protrusions.

3. The tripod type constant-velocity joint of claim 1 wherein said pair of curved side faces of each of said protrusions are portions of a sphere having a center located on an axis of the corresponding protrusion.

4. The tripod type constant-velocity joint of claim 1 wherein said pair of curved side faces of each of said protrusions are portions of a cylinder having its axis coincident with an axis of the corresponding protrusion.

5. The tripod type constant-velocity joint of claim 1 wherein said outer ring is formed of a synthetic resin.

6. The tripod type constant-velocity joint of claim 5 wherein said outer ring and said tripod member are formed of different synthetic resins.

7. The tripod type constant-velocity joint of claim 1 wherein said synthetic resin is an injection-moldable synthetic resin.

8. The tripod type constant-velocity joint of claim 7 wherein said synthetic resin is a lubricating resin.

9. The tripod type constant-velocity joint of claim 1 wherein a preload is applied to contact portions between said track grooves and said protrusions.

10. An image forming device comprising a photoconductor drum having drum shafts, a driving unit having a drive shaft for driving said photoconductor drum, a light exposure unit for forming an electrostatic latent image on said photoconductor drum, a developing unit for supplying toner to said electrostatic latent image on said photoconductor drum to form a toner image, a transfer unit for feeding a transfer material at the same speed as a peripheral speed of said photoconductor drum to transfer said toner image onto said transfer material, and a constant-velocity joint of claim 1 through which said drive shaft of said driving unit is coupled to one of said drum shafts of said photoconductor drum.

11. An image forming device comprising a photoconductor drum having drum shafts, a driving unit having a drive shaft for driving said photoconductor drum, a light exposure unit for forming an electrostatic latent image on said photoconductor drum, a developing unit for supplying toner to said electrostatic latent image on said photoconductor drum to form a toner image, a transfer unit for feeding a transfer material at the same speed as a peripheral speed of said photoconductor drum to transfer said toner image onto said transfer material, and a constant-velocity joint of claim 2 through which said drive shaft of said driving unit is coupled to one of said drum shafts of said photoconductor drum.

12. An image forming device comprising a photoconductor drum having drum shafts, a driving unit having a drive shaft for driving said photoconductor drum, a light exposure unit for forming an electrostatic latent image on said photoconductor drum, a developing unit for supplying toner to said electrostatic latent image on said photoconductor drum to form a toner image, a transfer unit for feeding a transfer material at the same speed as a peripheral speed of said photoconductor drum to transfer said toner image onto said transfer material, and a constant-velocity joint of claim 3 through which said drive shaft of said driving unit is coupled to one of said drum shafts of said photoconductor drum.

13. An image forming device comprising a photoconductor drum having drum shafts, a driving unit having a drive shaft for driving said photoconductor drum, a light exposure unit for forming an electrostatic latent image on said photoconductor drum, a developing unit for supplying toner to said electrostatic latent image on said photoconductor drum to form a toner image, a transfer unit for feeding a transfer material at the same speed as a peripheral speed of said photoconductor drum to transfer said toner image onto said transfer material, and a constant-velocity joint of claim 4 through which said drive shaft of said driving unit is coupled to one of said drum shafts of said photoconductor drum.

14. An image forming device comprising a photoconductor drum having drum shafts, a driving unit having a drive shaft for driving said photoconductor drum, a light exposure unit for forming an electrostatic latent image on said photoconductor drum, a developing unit for supplying toner to said electrostatic latent image on said photoconductor drum to form a toner image, a transfer unit for feeding a transfer material at the same speed as a peripheral speed of said photoconductor drum to transfer said toner image onto said transfer material, and a constant-velocity joint of claim 5 through which said drive shaft of said driving unit is coupled to one of said drum shafts of said photoconductor drum.

15. An image forming device comprising a photoconductor drum having drum shafts, a driving unit having a drive shaft for driving said photoconductor drum, a light exposure unit for forming an electrostatic latent image on said photoconductor drum, a developing unit for supplying toner to said electrostatic latent image on said photoconductor drum to form a toner image, a transfer unit for feeding a transfer material at the same speed as a peripheral speed of said photoconductor drum to transfer said toner image onto said transfer material, and a constant-velocity joint of claim 6 through which said drive shaft of said driving unit is coupled to one of said drum shafts of said photoconductor drum.

16. An image forming device comprising a photoconductor drum having drum shafts, a driving unit having a drive shaft for driving said photoconductor drum, a light exposure unit for forming an electrostatic latent image on said photoconductor drum, a developing unit for supplying toner to said electrostatic latent image on said photoconductor drum to form a toner image, a transfer unit for feeding a transfer material at the same speed as a peripheral speed of said photoconductor drum to transfer said toner image onto said transfer material, and a constant-velocity joint of claim 7 through which said drive shaft of said driving unit is coupled to one of said drum shafts of said photoconductor drum.

17. An image forming device comprising a photoconductor drum having drum shafts, a driving unit having a drive shaft for driving said photoconductor drum, a light exposure unit for forming an electrostatic latent image on said photoconductor drum, a developing unit for supplying toner to said electrostatic latent image on said photoconductor drum to form a toner image, a transfer unit for feeding a transfer material at the same speed as a peripheral speed of said photoconductor drum to transfer said toner image onto said transfer material, and a constant-velocity joint of claim 8 through which said drive shaft of said driving unit is coupled to one of said drum shafts of said photoconductor drum.

18. An image forming device comprising a photoconductor drum having drum shafts, a driving unit having a drive shaft for driving said photoconductor drum, a light exposure unit for forming an electrostatic latent image on said photoconductor drum, a developing unit for supplying toner to said electrostatic latent image on said photoconductor drum to form a toner image, a transfer unit for feeding a transfer material at the same speed as a peripheral speed of said photoconductor drum to transfer said toner image onto said transfer material, and a constant-velocity joint of claim 9 through which said drive shaft of said driving unit is coupled to one of said drum shafts of said photoconductor drum.

* * * * *